US010837432B1

(12) United States Patent
Kaminski

(10) Patent No.: US 10,837,432 B1
(45) Date of Patent: Nov. 17, 2020

(54) TABLETOP INFLATION SYSTEM

(71) Applicant: Mike Kaminski, San Jose, CA (US)

(72) Inventor: Mike Kaminski, San Jose, CA (US)

( * ) Notice: Subject to any disclaimer, the term of this patent is extended or adjusted under 35 U.S.C. 154(b) by 0 days.

(21) Appl. No.: 16/826,173

(22) Filed: Mar. 21, 2020

Related U.S. Application Data

(60) Provisional application No. 62/889,564, filed on Aug. 21, 2019.

(51) Int. Cl.

| | |
|---|---|
| ***F04B 33/00*** | (2006.01) |
| ***B65B 31/04*** | (2006.01) |
| ***B65B 39/10*** | (2006.01) |
| ***F04B 39/12*** | (2006.01) |
| ***B65B 39/08*** | (2006.01) |
| ***F04B 17/03*** | (2006.01) |
| ***B65B 39/06*** | (2006.01) |

(52) U.S. Cl.
CPC ..... *F04B 33/00* (2013.01); *B65B 31/044* (2013.01); *B65B 31/048* (2013.01); *B65B 39/06* (2013.01); *B65B 39/08* (2013.01); *B65B 39/10* (2013.01); *F04B 17/03* (2013.01); *F04B 33/005* (2013.01); *F04B 39/12* (2013.01); *F04B 39/123* (2013.01)

(58) Field of Classification Search
CPC ..... F04B 17/03; F04B 39/12; F04B 39/123; F04B 33/005; F04B 33/00; B65B 31/04; B65B 31/044; B65B 31/048; B65B 39/10; B65B 39/06; B65B 39/08
USPC ..... 141/10, 114, 314, 315
See application file for complete search history.

(56) References Cited

U.S. PATENT DOCUMENTS

| | | | | |
|---|---|---|---|---|
| 2,715,004 | A * | 8/1955 | Fox | B65B 39/04 248/101 |
| 3,851,444 | A * | 12/1974 | Merat | B65B 55/24 53/167 |
| 4,305,242 | A * | 12/1981 | Barathe | B65B 43/54 141/314 |
| 6,305,438 | B1 * | 10/2001 | Sjoholm | B65B 3/26 141/114 |
| 8,186,392 | B2 * | 5/2012 | Gustafsson | B65B 39/08 141/114 |
| 8,555,935 | B2 * | 10/2013 | Gustafsson | B65B 39/10 141/166 |

(Continued)

*Primary Examiner* — Christopher S Bobish
(74) *Attorney, Agent, or Firm* — Barry Choobin; Patent 360

(57) ABSTRACT

The present invention is directed to an inflation system comprising a housing; a clamp assembly, the clamp assembly having an elongated upper clamp and an elongated lower clamp, the upper clamp having a proximal end and a distal end, the lower clamp having a proximal end and a distal end, the upper clamp is mounted to the housing, the lower clamp is pivotally mounted along a lateral axis, the lateral axis is perpendicular to length of the lower clamp and between the proximal end and the distal end of the lower clamp, the proximal end of the upper clamp and the proximal end of the lower clamp protrudes from an opening in the housing; an upper cushion coupled to the proximal end of the upper clamp; a lower cushion coupled to the proximal end of the lower clamp such that the lower cushion and the upper cushion faces each other, the lower cushion and the upper cushion forms a passageway; and an air hose having a nozzle at one end wherein a portion of the air hose and a portion of the nozzle are retained in the passageway.

17 Claims, 11 Drawing Sheets

(56) References Cited

U.S. PATENT DOCUMENTS

| | | | | |
|---|---|---|---|---|
| 8,745,960 | B2 * | 6/2014 | Kannankeril | B31D 5/0073 53/284.7 |
| 9,873,232 | B2 * | 1/2018 | Eckhardt | B29C 73/166 |
| 10,160,176 | B2 * | 12/2018 | Sperry | B31D 5/0073 |
| 2003/0163976 | A1 * | 9/2003 | Perkins | B29C 66/439 53/403 |
| 2009/0078337 | A1 * | 3/2009 | Gustafsson | B65B 39/004 141/313 |
| 2019/0170298 | A1 * | 6/2019 | Zhang | F17C 5/00 |
| 2020/0024059 | A1 * | 1/2020 | Wetsch | B31D 5/0073 |

* cited by examiner

TABLETOP INFLATION SYSTEM

CROSS-REFERENCE TO RELATED APPLICATIONS

This application claims priority to the U.S. provisional patent application Ser. No. 62/889,564 filed Aug. 21, 2019, which is incorporated herein by reference in its entirety.

FIELD OF INVENTION

The present invention relates to a compact inflation system, and in more particularly, relates to a system and method for inflating packaging airbags.

BACKGROUND

The packaging is a means to protect an article from contamination, dirt, and damage. The packaging is of utmost significance in the manufacture, sale, and transport of articles. The primary purpose of the packaging is to protect an article from the environment. For example, packaging can protect an article from dust, water, etc. Also, the packaging has a primary function to protect an article from external shocks and bumps. This function of packaging is of importance in the transportation of fragile articles which are very suspectable to damage during transportation. Good packaging can protect an article from damage due to shocks or bumps both during transportation and mishandling of the article.

Different kinds of packaging materials are commercially available, such as paper, plastic, and cardboard. Each packaging material has its own uses and indications. The paper can be used to protect an article from dirt. The plastic can protect an article from both dirt and liquid. Cardboards, on the other hand, are sturdy and can provide limited protection against shocks. For enhanced protection against shocks, materials such as Styrofoam, foam, bubble packs, crumpled paper, or airbags, each being inserted inside a bag or container are popularly used.

Airbags are bags that can be inflated to protect an article contained in the bag. The airbag can be made of polyethylene or other materials having similar properties. The airbag is manufactured as a sheet having two overlapping plies. The two plies have air cavities which can be inflated with air. The air cavities are fluidly connected to an inflation port through unidirectional flow valves and inflatable tubes. The air can enter from the inflation port and uniformly distributes to the plurality of inflatable cavities. The unidirectional flow valve can be provided at the inflation port and prevents leaking of air. Moreover, the entry of each cavity can be provided with a unidirectional flow valve. This can be helpful in case, any cavity is ruptured, while the unidirectional flow valve prevents leakage of air from other cavities. The airbag can be manufactured in the form of a container. For example, airbag containers are used to contain glass bottles for protection against bumps. Such airbag containers have become quite popular for the transportation of wine bottles.

At retail outlets, costly glass articles, such as wine bottles are packed in airbag containers for protection against bumps. The airbag container is available as a sheet, which is inflated by a manual air pump. However, the use of manual pumps is both laborious and time-consuming. Thus, a need is appreciated for an improved inflation system for packaging airbags.

SUMMARY OF THE INVENTION

The principal objective of the present invention is therefore directed to an air inflation system for use in inflating packaging airbags.

It is an additional objective of the present invention that the inflation system is portable and compact.

It is a further objective of the present invention that the inflation system makes less noise during operation.

It is another objective of the present invention that the airbag can be mounted to the inflation system for inflating the airbag.

Yet it is another objective of the present invention that the inflation system is economical to manufacture and easy to use.

In one aspect, the present invention is directed to an inflation system for inflating packaging airbags. The inflation system comprises an air compressor housed in a compact housing. The air compressor fluidly connected to an air pressure regulator for controlling the air pressure within pre-determined limits. An air hose connects an outlet of the air regulator to a nozzle, where the nozzle can couple to an inflation port of the airbag for inflating the airbag.

In another aspect, the inflation system comprises a duckbill type clamp assembly, the clamp assembly comprises an upper clamp and a lower clamp positioned against each other. The upper clamp having a proximal end and a distal end, and the lower clamp having a proximal end and a distal end. The upper clamp is stationary, while the lower clamp is pivotally coupled near center of its length, resulting in the lower clamp to pivot around its pivot joint and relative to the first clamp. Each of the upper clamp and the lower clamp mounts an upper cushion and a lower cushion respectfully. The upper cushion and the lower cushion positioned near the proximal ends of the upper clamp and the lower clamp. The upper cushion and the lower cushion both having a longitudinal groove, which together forms a passageway for the air hose, the air hose connected to air pressure regulator at one end and to a nozzle at another end. Furthermore, the distal end of the lower clamp can be operably coupled to a pull type solenoid for pivoting the lower clamp relative to the upper clamp.

In one aspect, the upper cushion and the lower cushion can be positioned to face each other, such that the air hose can be positioned along the passageway, and wherein a portion of the nozzle can protrude outwards from the passageway. The solenoid is operable to pull the distal end of the lower clamp, resulting in the proximal end of the lower clamp to pivot upwards towards the upper cushion. To fill the airbag, an inflation port of the airbag can be sealably received into the inflation port, wherein a collar of the airbag adjacent to the inflation bag can lie between the upper cushion and the lower cushion. Turning ON the inflation system causes the lower clamp to pivot, wherein the lower cushion pushes the collar of the bag towards the upper cushion, thus retaining the collar of the bag while inflating the airbag. Turning the inflation system OFF, results in lowering of the lower clamp, releasing the collar of the airbag. The collar of the airbag herein refers to a portion of the airbag adjacent to the inflation port.

These and other objects and advantages of the embodiments herein will become readily apparent from the following detailed description taken in conjunction with the accompanying drawings

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, the reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is to describe particular embodiments only and is not intended to be limiting of embodiments of the invention. As used herein, the singular forms "a", "an" and "the" are intended to include the plural forms as well, unless the context indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

Figure 1:
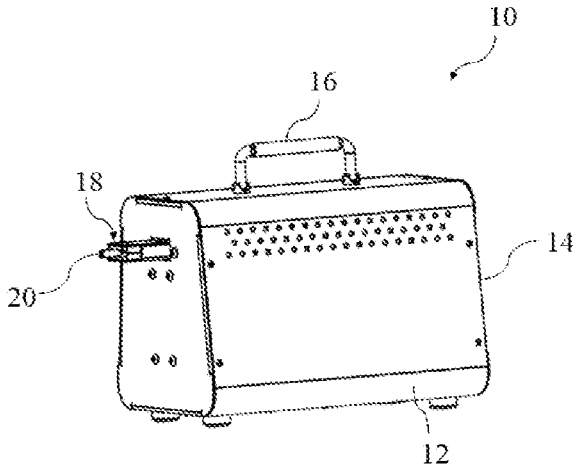
FIG. 1 is a front and side perspective view of an inflation system, in accordance with an embodiment of the present invention.
Figure 2:
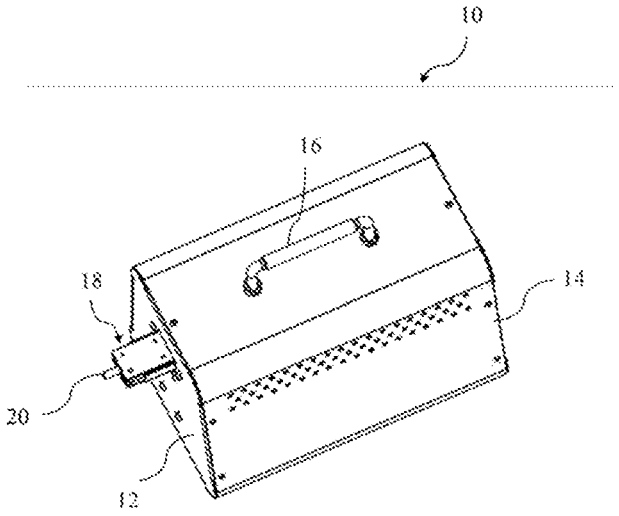
FIG. 2 is a top and front perspective view of the inflation system of FIG. 1, showing a handle and a clamp assembly.

The present invention is directed to a novel inflation system for inflating packaging airbags. FIG. 1 shows an exemplary embodiment of the inflation system which can be used to inflate the packaging airbags. Shown in FIG. 1 is the inflation system 10, according to an exemplary embodiment, that is compact and could be easily carried or placed on a table, hence also referred herein as a table-top inflation system. FIG. 1 shows a housing 12 which is covered by a thin sheet steel cover 14. The cover 14 is having a plurality of holes near the top portion for air circulation. Furthermore, the cover 14 is shown to be secured to the housing 12 through a plurality of screws. On top of the cover is a handle 16 that is integrated to the cover 14, the handle 16 can be used to carry the inflation system 10. The housing 12 can act as a frame to which different components of the inflation system 10 can be assembled. A clamp assembly 18 is shown in FIG. 1 to be protruding from an opening provided on a side wall of the housing 12. A nozzle 20 can also be seen protruding from the clamp assembly 18. FIG. 2 shows a top and side perspective view of the inflation system 10 according to an exemplary embodiment of the present invention. The clamp assembly 18 can be more clearly seen, in FIG. 2, protruding from the opening in the housing 12. Also, the handle 16 can be seen clearly in FIG. 2 to be integrated to the cover 14.

Figure 3:
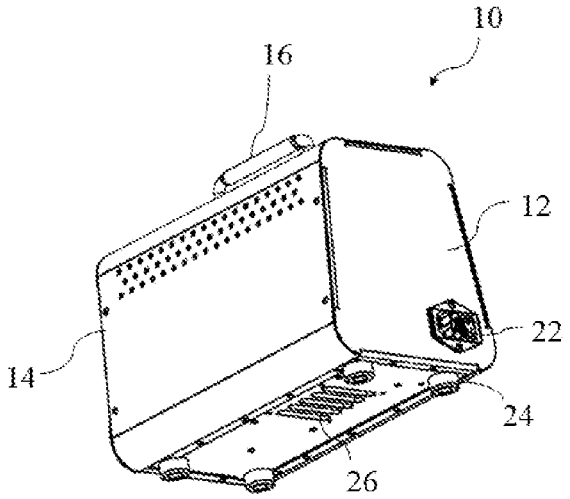
FIG. 3 is a bottom and side perspective view of the inflation system of FIG. 1, showing an air vent and a power interface.

FIG. 3 shows the bottom and side perspective view of the inflation system 10 in accordance with an exemplary embodiment of the present invention. A power interface 22 can be seen coupled to the housing 12, wherein the power interface 22 can have an input for a power cable and a switch for turning the inflation system 10 On and OFF. On the bottom side of the housing 12, can be seen elongated perforations configured in a base of the housing 12. These perforations can act as an air vent 26 for receiving air into the housing 12.

Figure 4:
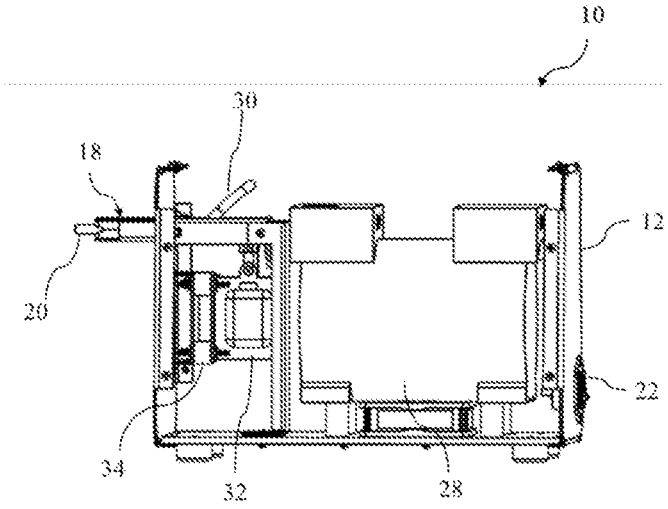
FIG. 4 is a side view of the inflation system of FIG. 1, showing the internal components of the inflation system.

The different components of the inflation system 10 can be seen in FIG. 4. The air compressor 28 is mounted to the base of the housing 12. The air compressor 28 is preferably a low noise air compressor, and more preferably, a silent air compressor. In one case, a muffler can be provided at an air input of the air compressor 28 to decrease its noise. Construction and working of air compressors for portable inflation devices are known to a skilled person and all the known types of air compressors with or without tanks are within the scope of the present invention. The air compressor 28 can be connected to an input port of an air pressure regulator (not shown). The air pressure regulator controls the pressure of the compressed air from the air compressor 28 within the set limits. The limits of air pressure can be set by a user, wherein the limits of air pressure can depend upon the packaging airbags to the inflated by the inflation system 10. In a preferred embodiment, the air pressure can be regulated to be within the range of 8.8 to 10 PSI. In a more preferred embodiment, the air pressure can be set at 8.8 PSI. An air hose 30 connects an out port of the air pressure regulator to a nozzle 20. The air hose 30 can be seen more clearly in FIG.

Figure 5:
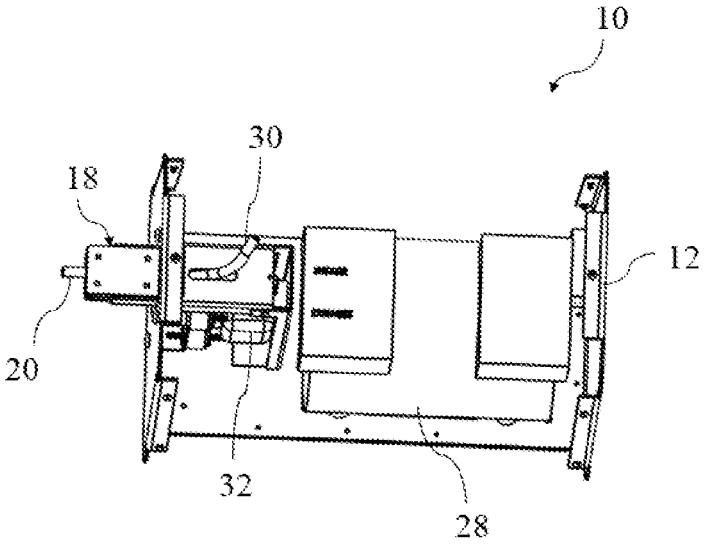
FIG. 5 is a top and front perspective view of the inflation system of FIG. 4, in accordance with an embodiment of the present invention.

5, wherein the end of the air hose 30 is shown open i.e. not coupled to the air pressure regulator. Further can be seen in FIG. 5 is the air hose 30 passing to the clamp assembly 18 through an elongated aperture in the clamp assembly 18. The clamp assembly can have a passageway for the air hose 30, wherein a portion of the nozzle 20 can protrude from the clamp assembly 18. Further can be seen in FIG. 4 is a solenoid 32 mounted to the housing 12 and operably coupled to the clamp assembly 18.

Figure 6:
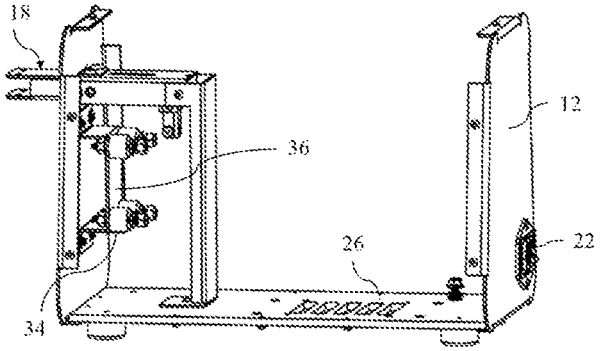
FIG. 6 is a side view of the housing showing the power interface, the clamp assembly, and a solenoid clamp, in accordance with an embodiment of the present invention.
Figure 7:
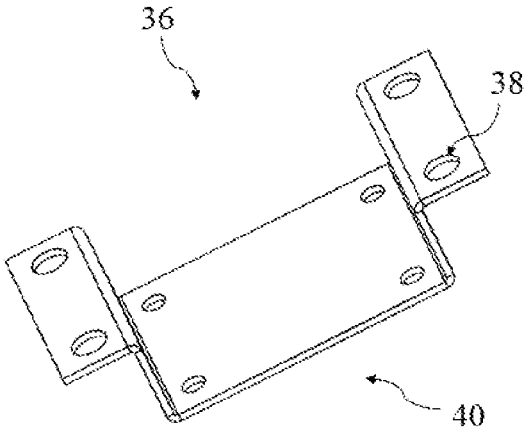
FIG. 7 shows the solenoid clamp, in accordance with an embodiment of the present invention.

FIG. 6 shows the solenoid clamp 36 for mounting the solenoid 32 to the housing 12. Further can be seen in FIG. 6 is the air vent 26, power interface 22, clamp assembly 18, and the spacers 34. The solenoid clamp 36 can more be clearly seen in FIG. 7, which shows a clamp with two perpendicular flanges. The two flanges are having four apertures 38 for the bolts that are used to couple the solenoid clamp 36 to the housing 12. Another four apertures 40 can be used to couple the solenoid 32 through bolt and nuts. The spacing between the solenoid 32 and the solenoid clamp 36 can be adjusted through the spacers 34 shown in FIGS. 4 and 6. In a preferred embodiment, the spacers 34 can be made of any soft material that can dampen the vibrations, for example rubber is known to reduce the vibrations. Additionally, the bolts to secure the solenoid 32 to the clamp 36, and the clamp 36 to the housing can be incorporated with dampeners to reduce the vibrations. In one case, the bolts can be replaced with studs made of material that can decrease the vibrations.

Figure 8:
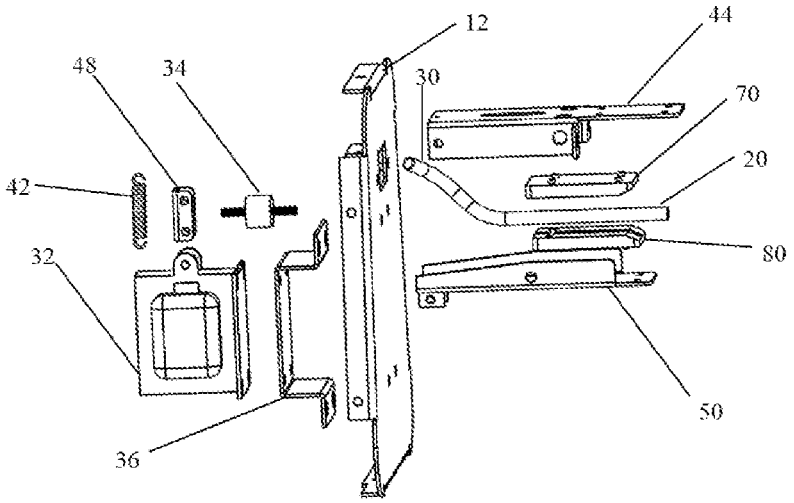
FIG. 8 is an exploded view of a portion of the inflation system showing the solenoid and the clamp assembly, in accordance with an embodiment of the present invention.
Figure 9:
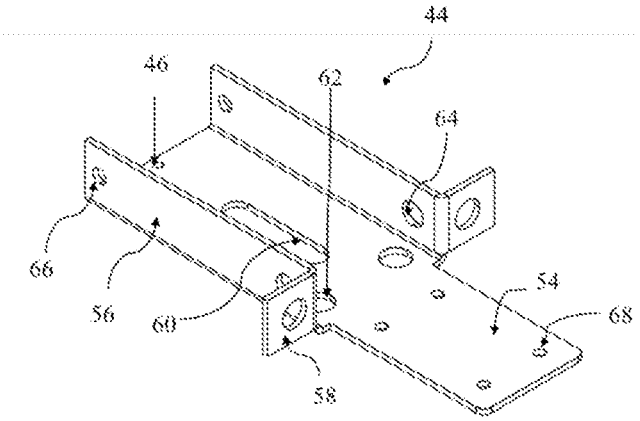
FIG. 9 is a perspective view of an upper clamp of the clamp assembly, in accordance with an embodiment of the present invention.
Figure 10:
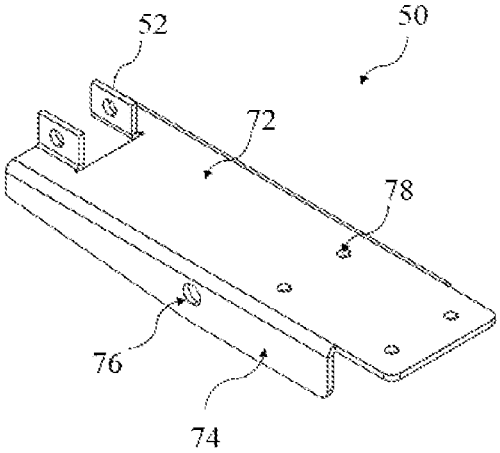
FIG. 10 is a bottom view of a lower clamp of the clamp assembly, in accordance with an embodiment of the present invention.

FIG. 8 shows an exploded view of the front portion of the inflation system of FIG. 1 which showing the solenoid 32 and the clamp assembly 18. As discussed above, the solenoid 32 is mounted to the side of the housing 12 through the solenoid clamp 36. The space between the solenoid 32 and the solenoid clamp 36 can be adjusted using the spacers 34. FIG. 8 shows four such kind of spacers to adjust the space between the solenoid 32 and the solenoid clamp 36. Furthermore, it can be seen in FIG. 8 is a piston extension spring 42 coupled to the solenoid 32. The solenoid 32 is a pull type solenoid, wherein the piston extension spring 42 can be coupled to a piston 48 of solenoid 32, to keep the piston in extended configuration. Thus, one end of the piston extension spring 42 can eb coupled to the piston 48 of the solenoid 32, while the other end of the piston extension spring 42 can hook to a stationary upper clamp 44 of the clamp assembly 18. An embodiment of the upper clamp 44 is shown in FIG. 9 which has a small aperture 46 to which the piston extension spring 42 can hook. The piston 48 can be operably coupled to the lower clamp 50 to pivot the lower clamp 50 relative to the stationary upper clamp 44. The piston 48 can be secured to the perpendicular flanges 52 that extends downwards in the lower clamp 50. An embodiment of the lower clamp 50 is shown in FIG. 10, which has a pair of flanges 52 that extends downwards and perpendicular to a base 72 of the lower clamp 50. In one case, the piston 48 can be secured to the flanges 52 of the lower clamp 50 using fasteners, such as but not limited to nut and bolt.

The clamp assembly 18 can now be explained with the help of FIGS. 8-11, as having the upper clamp 44 and lower clamp 50. The upper clamp having a proximal end and a distal end. The upper clamp 44 is more clearly shown in FIG. 9 as having a flat base 54, a pair of first flanges 56 that extends perpendicularly from opposite edges of the base 54, and another pair of second flanges 58 that are perpendicular to the first pair of flanges 56 and the base 54. The first pair of flanges 56 can extend from distal end of the upper clamp 44 up to near the center. The first pair of flanges 56 terminate into the second pair of flanges 58. The upper clamp 44 can be coupled to the housing 12 at the second pair of flanges 58, such that the proximal end of the first pair of flanges 56 can protrude from the opening of the housing 12. The elongated aperture 60 can be seen configured in the base 54 of the upper clamp 44 which can receive the air hose 30. The two apertures 62 in the base 54 of the upper clamp 44 can be used to further secure the upper clamp 44 to the housing 12. As discussed before, the aperture 46 can be used to hook the piston extension spring 42. The two apertures 64 in the first pair of flanges 56 and positioned near the center of the upper clamp 44, can be used to secure the lower clamp 50. The two apertures 66 again in the first pair of flanges 56 and at the distal ends can also be used to secure the upper clamp 44 to the housing 12. The upper clamp 44 is shown in FIG. 8 to be positioned above the lower clamp 50, with the base 54 facing upwards. The four small apertures 68 in the base 54 near the proximal ends of the upper clamp 44 can be used to secure the upper cushion 70.

Figure 11:
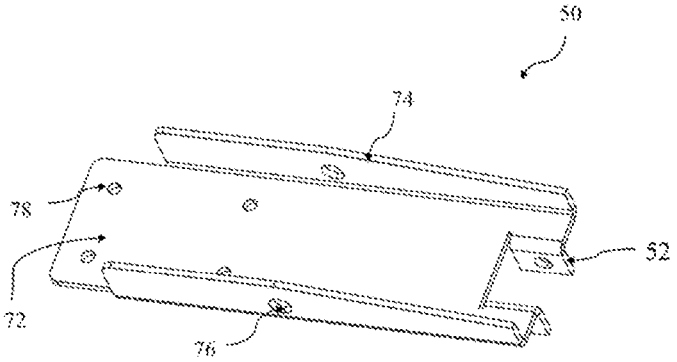
FIG. 11 is a top and side perspective view of the lower clamp of FIG. 10, in accordance with an embodiment of the present invention.

The lower clamp is shown in FIGS. 10 and 11 as having a base 72 and pair of flanges 74 that extends perpendicularly from opposite edges the base 72. The lower clamp 50 having a proximal end and a distal end, the proximal end of the lower clamp 50 protrudes from the opening in the housing 12. Two opposite apertures 76 in the pair of flanges 74 are positioned near the center of the length of the lower clamp 50 and can be used to secure the lower clam 50 to the upper clamp 44. The apertures 76 are positioned to be registered with the apertures 64 of the upper clamp 44, wherein the lower clamp 50 can be pivotally mounted to the upper clamp 44 at the apertures 76. The four apertures 78 near the proximal end of the lower clamp 50 can secure the lower cushion 80. FIG. 8 shows the upper cushion 70 and the lower cushion 80 which together are having a passageway for the hose 30. Both the upper cushion 70 and the lower cushion 80 can have a longitudinal groove facing each other, such as to form the passageway for the air hose 30 and the nozzle 20.

In one embodiment, an airbag having an inflation port can be filled with the inflation system 10. The inflation port of the airbag can be sealably received into the nozzle 20, wherein a collar of the airbag adjacent to the inflation port lies between the upper cushion 70 and the lower cushion 80. Thereafter the inflation system 10 can be turned ON, wherein the solenoid 32 operates to pull the distal end of the lower clamp 50, resulting in the proximal end of the lower clamp 50 to pivot towards the proximal end of the upper clamp 44. As a result, the lower cushion 80 can press against the upper cushion 70, wherein the collar of the air bag can be held between the upper cushion 70 and the lower cushion 80. In one case, the upper cushion and the lower cushion can be made of any soft material, such as rubber pads. The air compressor 28 operates to supply air under pressure to the airbag through the air pressure regulator. Once the airbag is inflated, the inflation unit 10 can be turned OFF, resulting in releasing of the lower clamp, and the airbag can then be removed from the nozzle 20.

The power supply to the inflation system 10 can be transmitted through a power cord, wherein the power interface 22 can receive the power cord. The power interface 22 can also be provided with a fuse to protect any damage from electricity. The power cable can be interrupted with a foot-pedal switch, such that the foot-pedal switch can be pressed to allow the power to transmit to the inflation system 10. Releasing the foot-pedal switch cut-off the power supply thereby turning the to the inflation system 10 OFF. It will be appreciated by a skilled person that any other mechanism to turn the inflation apparatus on and off is within the scope of the present invention.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An inflation system comprising:

a housing;

a clamp assembly, the clamp assembly having an elongated upper clamp and an elongated lower clamp, the upper clamp having a proximal end and a distal end, the lower clamp having a proximal end and a distal end, the upper clamp is mounted to the housing, the lower clamp is pivotally mounted along a lateral axis, the lateral axis is perpendicular to length of the lower clamp and between the proximal end and the distal end of the lower clamp, the proximal end of the upper clamp and the proximal end of the lower clamp protrudes from an opening in the housing;

an upper cushion coupled to the proximal end of the upper clamp;

a lower cushion coupled to the proximal end of the lower clamp such that the lower cushion and the upper cushion faces each other, the lower cushion and the upper cushion forms a passageway; and an air hose having a nozzle at one end wherein a portion of the air hose and a portion of the nozzle are retained in the passageway.

2. The inflation system of claim 1, wherein the inflation system further comprises a solenoid having a piston, the piston is operably coupled to the distal end of the lower clamp such that the distal end of the lower clamp pivots to move the proximal end of the lower clamp towards the proximal end of the upper clamp pressing at least a portion of the lower cushion against at least a portion of the upper cushion.

3. The inflation apparatus of claim 2, wherein the solenoid is a pull solenoid.

4. The inflation apparatus of claim 3, wherein the solenoid further comprises a spring, the spring configured to keep the piston in an extended configuration.

5. The inflation apparatus of claim 4, wherein the spring is having a first end and a second end, the first end coupled to the piston and the second end coupled to the distal end of the upper clamp.

6. The inflation system of claim 2, wherein the solenoid is coupled to a solenoid clamp and the solenoid clamp is coupled to the housing, the solenoid coupled to the solenoid clamp through dampers, the dampers configured to reduce vibrations.

7. The inflation system of claim 1, wherein the air hose is further connected to a pressurized air source at its other end.

8. The inflation system of claim 7, wherein the nozzle is configured to receive an inflation port of a packaging airbag.

9. The inflation system of claim 8, wherein the nozzle is of a length such that a collar of the packaging airbag lies between the upper cushion and the lower cushion when the inflation port is received into the nozzle, the collar is a portion of the packaging airbag adjacent to the inflation port.

10. The inflation system of claim 7, wherein the pressurized air source is an air compressor.

11. The inflation system of claim 10, wherein the air hose is connected to an out-port of an air pressure regulator and an in-port of the air pressure regulator is connected to the air compressor, the air pressure regulator is configured to regulate pressure of the air within predetermined limits.

12. The inflation system of claim 11, wherein the predetermined limit is in a range of 8.8 to 10 psi.

13. The inflation system of claim 1, wherein a first pair of flanges having a first pair of apertures extends downwards from the upper clamp, a second pair of flanges extend upwards from the lower clamp, the second pair of flanges having a second pair of apertures positioned to be registrable with the first pair of apertures, and the lower clamp pivotally coupled to the upper clamp at the first pair of apertures and the second pair of the apertures.

14. The inflation system of claim 1, wherein the inflation system further comprises a foot pedal switch, the foot pedal switch configured to control power supply to the inflation system.

15. The inflation system of claim 1, wherein the upper cushion is having a first longitudinal groove, the lower cushion is having a second longitudinal grove, wherein the first longitudinal groove and the second longitudinal groove forms the passageway.

16. The inflation system of claim 1, wherein the upper cushion and the lower cushion are rubber pads.

17. The inflation system of claim 1, wherein the housing is having a rectangular base, two upright walls at short sides of the base, an open top, and two open sides at longer sides of the base, the opening is provided in one of the two upright walls, the open top and the two open sides are covered by a cover, the cover having a handle.

* * * * *